US010060704B2

(12) United States Patent
Brice

(10) Patent No.: US 10,060,704 B2
(45) Date of Patent: Aug. 28, 2018

(54) SCOPE MOUNT DEVICE

(71) Applicant: William T. Brice, Gilbert, AZ (US)

(72) Inventor: William T. Brice, Gilbert, AZ (US)

( * ) Notice: Subject to any disclaimer, the term of this patent is extended or adjusted under 35 U.S.C. 154(b) by 0 days.

(21) Appl. No.: 15/380,070

(22) Filed: Dec. 15, 2016

(65) Prior Publication Data

US 2018/0172405 A1 Jun. 21, 2018

(51) Int. Cl.
*F41G 11/00* (2006.01)
*F41G 1/387* (2006.01)

(52) U.S. Cl.
CPC ..... *F41G 11/001* (2013.01); *F41G 1/387* (2013.01); *F41G 11/005* (2013.01)

(58) Field of Classification Search
CPC ..... F41G 1/38; F41G 1/387; F41G 11/001; F41G 11/003; F41G 11/005
USPC ..... 42/119, 124–128
See application file for complete search history.

(56) References Cited

U.S. PATENT DOCUMENTS 2,002,324 A * 5/1935 Lefever ..... F41G 1/42 42/143
2,117,634 A * 5/1938 Smith ..... F41G 11/002 42/126
2,155,389 A * 4/1939 Arden ..... F41G 1/40 356/21
2,155,391 A * 4/1939 Arden ..... F41G 1/28 42/125
2,392,122 A * 1/1946 Dake ..... F41G 1/38 356/251
2,426,812 A * 9/1947 Bennett ..... F41G 1/24 356/17
2,475,383 A * 7/1949 Foster ..... F41G 11/007 42/127
2,743,526 A * 5/1956 Ivy ..... F41G 11/002 42/126
2,803,907 A * 8/1957 Weaver ..... F41G 1/38 42/124
3,187,435 A * 6/1965 Miller, Jr. ..... F41G 11/001 42/126
3,463,430 A * 8/1969 Jimenez ..... F41G 11/003 248/229.15
3,579,840 A * 5/1971 Heinzel ..... F41G 11/003 42/127
3,835,565 A * 9/1974 Weast ..... F41G 11/003 42/124
3,986,285 A * 10/1976 Krisay ..... F41G 11/003 42/127
4,026,055 A * 5/1977 Weast ..... F41G 11/003 42/124

(Continued)

OTHER PUBLICATIONS

Bill Brice, Red Ryder Scope Mount, Dec. 18, 2010, JuniorShooters.net, pp. 6-9.*

(Continued)

*Primary Examiner* — Stephen Johnson
*Assistant Examiner* — Benjamin S Gomberg
(74) *Attorney, Agent, or Firm* — Weiss & Moy, P.C.; Jeffrey D. Moy; Veronica-Adele R. Cao

(57) ABSTRACT

A scope mount with a rectangular plate with a top channel that extends to an upper portion of the rectangular plate, a bottom channel that is perpendicular to the top channel, a hole for a screw to be inserted through to secure the plate to a Daisy® Red Ryder BB Gun to allow an optic sight to be mounted to the Daisy® Red Ryder BB Gun.

16 Claims, 2 Drawing Sheets

(56) References Cited

U.S. PATENT DOCUMENTS

| | | | | | |
|---|---|---|---|---|---|
| 4,291,476 | A * | 9/1981 | Repa | F41G 11/003 | 42/124 |
| 4,509,282 | A * | 4/1985 | McMillon | F41G 11/003 | 42/124 |
| 4,799,325 | A * | 1/1989 | Booze | F41G 1/01 | 42/124 |
| 5,337,506 | A * | 8/1994 | Klotz | F41G 11/003 | 42/124 |
| 5,425,191 | A * | 6/1995 | Taylor | F41G 11/001 | 42/124 |
| 5,896,850 | A * | 4/1999 | Sullivan, Jr. | F41A 35/02 | 124/74 |
| 6,000,667 | A * | 12/1999 | Isbell | F41G 1/38 | 248/201 |
| 6,073,351 | A * | 6/2000 | Barnett | F41G 1/467 | 42/136 |
| 6,591,538 | B2 * | 7/2003 | Holler | F41G 11/005 | 42/125 |
| 9,052,163 | B2 * | 6/2015 | Weigand | F41G 11/001 | |
| 9,863,741 | B2 * | 1/2018 | Tresserras Torre | F41G 11/002 | |
| 2009/0064562 | A1 * | 3/2009 | Casas Salva | F41G 11/003 | 42/124 |

OTHER PUBLICATIONS

Jim Bianchi, I scoped a Daisy Red Rider today, Dec. 30, 2010, Airgun forum, p. 1.*

Lasso Scope Mount Reviews, Dec. 2, 2016, PyramydAir, pp. 3-4 (Year: 2016).*

Pyramydair, Red Ryder Lasso Mount Installation, Nov. 29, 2016, Youtube (Year: 2016).*

* cited by examiner

SCOPE MOUNT DEVICE

TECHNICAL FIELD

This disclosure generally relates to a Scope Mount Device, and more particularly, to a device that can be attached to the top of a Daisy® Red Ryder BB Gun so that an optic sight (scope, red dot or laser) can be mounted to this gun by attaching the optic sight to the device.

BACKGROUND

Since 1935, Daisy® Red Ryder BB Gun has been sold. Its lever-cocking spring air action propels BBs at a maximum velocity of 350 feet per second and the gun has a 650 shot capacity. It is a very popular BB gun. This gun is sold without any optic sighting device.

A person using the gun to shoot at the intended target uses two sights on the gun to aim at the target. When using the two sights, one of which is on the top of the front of the gun and one is on the top of the gun above the gun's receiver, the user lines up the sights and aims for the bottom of the target. The rear sight is mechanical and therefore only allows for adjustments up and down to the strike of the projectile, or BB, as fired from the gun. The up and down adjustments are made by inserting the elevation ramp that comes with the Daisy® Red Ryder BB gun further or lesser under the rear sight. This sight does not permit adjustments to move the strike of the BB left or right. As offered by the manufacturer, the gun is described as reasonably accurate to a maximum distance, or range, of 15 feet The rear sight has a slot in which the elevation ramp fits. The elevation ramp comes with the gun and a user may slide the rear ramp further under the rear sight by pushing the ramp further back. This raises the rear sight and the strike of the BB is raised at the target.

As produced by the manufacturer, the Daisy® Red Ryder BB gun cannot be equipped with any optional sighting device. An optic sight is much more accurate and allows the shooter to aim the scope at the center of the target instead of below the center of the target if the optic sight were not mounted to the BB gun. To overcome this, the inventor of this invention previously invented the BriceMount ⅜" mount, or rail, to allow one to attach an optic sight to the Daisy® Red Ryder BB gun. The original Brice Mount model used a machine screw and accompany hardware consisting of a flat washer, a lock washer and an acorn nut to attach the mount to the rear sight of the BB gun.

While the original Brice Scope Mount allowed an optic sight to be mounted to the Daisy® Red Ryder BB Gun, it required the user to take out the rear screw and insert a spacer in order to raise the mount so that the optic sight can be accurately aimed at the intended target. Without the spacer in the original Brice Scope Mount, the Daisy® Red Ryder BB Gun would end up shooting in the ground instead of hitting the intended target.

The present disclosure provides a simpler Scope Mount that is easier to install, faster to install and uses the existing ramp of the Daisy® Red Ryder BB Gun without the need to replace it. The spacer is retained in this new cope mount. This new scope mount represents a significant technological improvement to the existing model, in that the improved mount utilizes only the rear sight hardware that comes with the gun. The new invention eliminates the need for these small hardware pieces. The new scope mount invention also has these advantages over the prior art. It eliminates costly hardware pieces and therefore lowers the cost to manufacture and sell. A second advantage is that eliminating the extra pieces, the rear sight elevation ramp is returned to its original position on the gun which makes it easier for a user to install the new scope mount. A third advantage is that by keeping the rear sight elevation ramp that comes with the Daisy® Red Ryder BB gun, a shooter can take off the optic sight mount and easily thus return the gun to its original configuration without having to reinstall the rear sight elevation ramp that came with the gun as was necessary with the prior scope mount. A fourth advantage is the degree of security of installation that can be regulated by the extent to which the rear sight elevation ramp is inserted into the channel in the top front of the mount and the rear sight slot. A fifth advantage is the esthetics of the gun are better preserved as there is little in the way of extraneous hardware needed for the installation of the mount.

This prior scope mount utilized the mechanical rear sight as the front anchor point for the mount which could be called a rail. The rail is held in place at the front anchor point by utilization of a small machine screw inserted vertically through a counter-sunk hole in the rail then through the slot in the rear sight, then held in place by a small flat washer, a lock washer and finally an acorn nut. This screw, small flat washer, lock washer and acorn nut were all new parts included with the rail. The rear anchor point of the rail utilizes a screw already in the gun that secures the receiver to the receiver. The receiver is a part of a rifle to which the barrel and firing mechanism are attached, that is held against one's shoulder when firing the gun. The mount enables the gun to be equipped with standard ⅜ inch dovetail sighting devices; telescopes, red dot sights or laser sights. The ⅜ inch dovetails are grooves in the top of the rail which are placed ⅜ inch apart and designed to accept optic sights compatible with this system.

As a result, outside of the new mount and using a screw driver, no additional parts are required and the user can use the existing parts from the Daisy® Red Ryder BB Gun to install the new mount and then attach an optic sight to the mount. Other benefits and advantages will become clear from the disclosure provided herein and those advantages provided above are for illustration.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with the present disclosure, a scope mount device for the Daisy® Red Ryder BB Gun is provided.

BRIEF DESCRIPTION OF DRAWINGS

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

The foregoing description is provided to enable any person skilled in the relevant art to install the scope mount on a Daisy® Red Ryder BB Gun. Moreover, nothing disclosed herein is intended to be dedicated to the public regardless of whether such disclosure is explicitly recited in the claims.

Embodiments of this disclosure relate generally to a scope mount, and more particularly, to a scope mount which is designed to be mounted to a Daisy® Red Ryder BB Gun in order to attach an optic sight to this particular Daisy® Red Ryder BB Gun.

The scope mount in this invention has a rectangular plate which may be made of metal or plastic.

The scope mount is designed to be mounted or attached to the top of a Daisy® Red Ryder BB Gun in order for an optic sight to be attached to the Daisy® Red Ryder BB Gun.

A primary distinguishing feature of the scope mount is the channel on the front of the mount that enables the existing adjustable rear sight ramp of the Daisy® Red Ryder BB gun to be used as the anchoring mechanism to anchor the front of the mount to the Daisy® Red Ryder BB gun.

Figure 1:
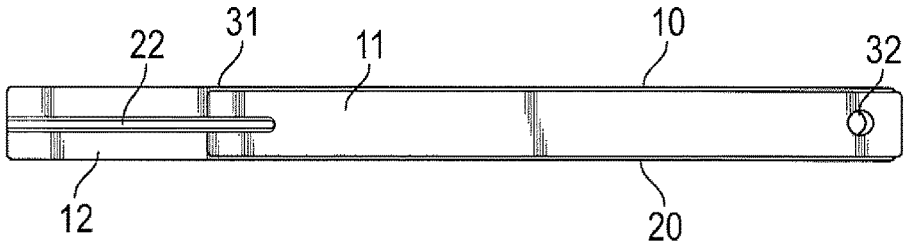
FIG. 1 is a top perspective view of the new scope mount of the present disclosure.
Figure 2:
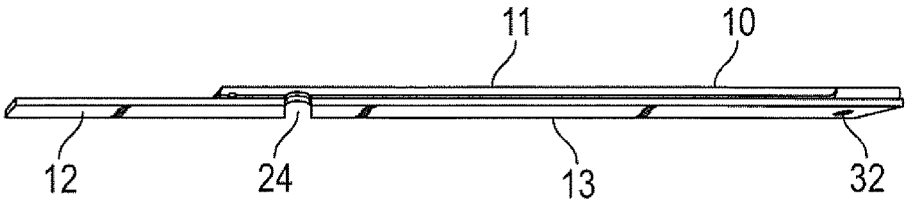
FIG. 2 is a left side perspective view, with the right side view being a mirror image thereof, showing the scope mount.
Figure 3:
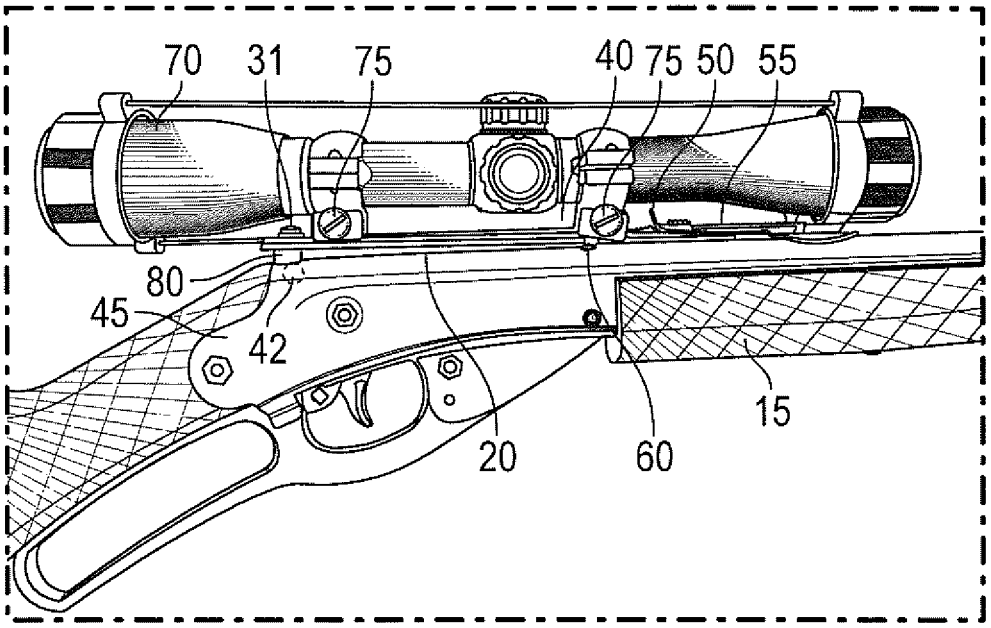
FIG. 3 is a right side perspective view of a Daisy® Red Ryder BB Gun with an optic sight mounted using the new scope mount device, as it would appear in use.

Turning now to the drawings, in which like reference characters indicate corresponding elements throughout the several views. With reference now to FIGS. 1 to 3, a top perspective view of a scope mount 10 of the present invention is shown. The scope mount 10 is a rectangular plate 20 with side grooves 40. The rectangular plate 20 has both an upper portion 11 and two lower portions 12 and 13.

The rectangular plate 20 has a substantially flat surface 30 with an edge that separates the lower front portion 12 from the upper back portion 11. The lower front portion 12 is created when a portion of the rectangular plate 20 is removed thereby forming the lower front portion 12 of the rectangular plate 20. The lower portion 12 of the plate has a bottom channel 24 or groove formed therein. The bottom channel 24 or groove does not go all the way through the rectangular plate 20.

The bottom channel 24 or groove in the lower front portion of the rectangular plate 20 extends into part of the upper front portion 11 of the rectangular plate 20. The lower front portion 12 of the rectangular plate 20 was created in order to allow the lower front portion 12 to slide under the existing adjustable rear sight 50 of the Daisy® Red Ryder BB Gun 15.

Only the existing rear sight hardware 50 and 55 that the Daisy® Red Ryder BB Gun 15 comes equipped with is needed to install the new scope mount. The Daisy® Red Ryder BB Gun 15 adjustable rear sight 50 uses a ramp 55 to allow a person to adjust the height of the rear sight. The scope mount 10 is designed with two channels. A top channel 22 that sits on top of the front of the rectangular plate 20 and a bottom channel 24 that is on the bottom of the rectangular plate 20, which begins where the top channel 22 ends, and is also perpendicular to the top channel 22 of the rectangular plate 20.

The top channel 22 cut in the top front of the rectangular plate 20 is designed to slide under both the adjustable rear sight 50 and elevation ramp 55 and allow the rear sight elevation ramp to act as one of two anchor points for the front of the rectangular plate 20. The bottom channel 24 is needed to allow the rectangular plate 20 to go over the ridge 60 which sits on top of and further back on the receiver 45 of the Daisy® Red Ryder BB Gun 15 and secured to the adjustable rear sight 50 and ramp 55. Therefore, the lower front 12 of the rectangular plate 20 is secured tightly to the Daisy® Red Ryder BB Gun 15 through the use of the top channel 22 and bottom channel 24 on the rectangular plate 20.

On top of the back end of the Daisy® Red Ryder BB Gun is a threadable formed opening 32 where the existing dual round head (Phillips slotted) screw 31 from the Daisy® Red Ryder BB Gun 15 can be reinserted into the threadable formed opening 32 to attach the rectangular plate 20 to the Daisy® Red Ryder BB Gun 15.

The bottom channel 24 and the rear hole in the mount formed opening 32 have to match the exact distance between the ridge 60 and the threadable opening 42 on the Daisy® Red Ryder BB Gun 15 in order for the rectangular plate 20 to be properly installed on the Daisy® Red Ryder BB Gun 15.

To install the new scope mount, a person unscrews and removes the rear screw 31 that is attached to the receiver 45 of the Daisy® Red Ryder BB Gun 15 and also removes the rear sight elevation ramp from the rear sight. The scope mount 10 is then attached to the Daisy® Red Ryder BB Gun 15 by lifting the rear sight 50 sans ramp and then sliding the lower front end 12 of the rectangular plate 20 with the top channel 22 or groove facing up underneath the existing rear sight 50. The top channel 22 or groove on the lower front plate is designed to permit the reinsertion of the elevation ramp 55 into it and it acts as the anchor point for the lower front 12 portion of the mount. The elevation ramp 55 is inserted in its original position on the gun and serves as the secure anchor point for the front of the mount. The back of the new scope mount is then aligned over the receiver of the Daisy® Red Ryder BB Gun so that the opening 32 as shown in FIG. 1 lines up with the threadable hole 42 on the receiver 45 of the Daisy® Red Ryder BB Gun 15 so that the original screw 31 can be used to attached the rectangular plate 20 to the receiver 45 of the Daisy® Red Ryder BB Gun 15. A spacer 80 is then placed between the rectangular plate 20 and the receiver 45 over the threadable hole 42 in the receiver 45 and aligned with the hole 32 in the rectangular plate 20. The rear receiver screw 31 is then reinstalled through the rectangular plate 20, through the spacer 80, and into the threadable hole 42 in the receiver 45. Once the rear receiver screw 31 is tightened, the rectangular plate 20 is securely fastened to the Daisy® Red Ryder BB Gun 15.

Next, a commercially available telescopic sighting scope 70 can then be quickly and easily mounted to scope mount 10 by attaching it to rectangular plate 20. This is accomplished using the parts that come with a telescopic sighting scope includes screws 75 that are used to tighten the optic sight 70 to the rectangular plate 20 of scope mount 10.

Using adjustments provided as illustrated in the present invention, coarse windage and elevation adjustments might be made so as to bring final adjustments within the range of the windage and elevation adjustments incorporated into optic sight FIG. 3 shows an optic sight 70 mounted on the Daisy® Red Ryder BB Gun 15 using the scope mount 10. Optic sights 70 are sold separate from the Daisy® Red Ryder BB Gun 15 and come with its own screws 75 which are used to attach the optic sight to the scope mount 10 by attaching it to the grooves 40.

The scope mount 10 can also be made using three separate plates to look identical to the one plate version. This is done by welding the upper top plate 11 to the bottom front plate 12 and bottom back plate 13 to create the side grooves 40. When using three separate plates the upper plate 11 will have a channel or groove that goes all the way through the upper plate. The front bottom plate will have the same channel or groove and will align with the channel or groove of the top plate. The top plate 11 will have the hole 32, which in one embodiment is threadable, that will extend through the bottom rear plate 13 for insertion of the screw 31 from the Daisy® Red Ryder BB Gun 15.

The groove or bottom channel 24 on rectangular plate 20 and threadable hole 32 are made to align to the Daisy Red Ryder BB Gun's ridge 60 and the threadable hole 42 on the receiver of the Daisy Red Ryder BB Gun. That distance is four and five/sixteenth's inches.

The lower front portion 12 of the rectangular plate 20 can be made to be a minimum of one and three quarters inches long and no longer than two and one half inches. In the preferred embodiment, the length of the lower front portion 12 is two inches long.

While the scope mount 10 may be made on one plate or three plates, it should be understood that the rear lower plate can be split up into two separate plates so that there could be three plates.

In the preferred embodiment, the upper plate 11 is five and one half inches long.

In the preferred embodiment, the length of the rectangular plate from the front of the lower plate 12 to the end of the bottom back plate 13 is seven inches long.

While we have shown and described the embodiments in accordance with the present invention, it should be clear to those skilled in the art that further embodiments may be made without departing from the scope of the present invention.

What is claimed is:

1. A scope mount for a BB gun comprising:
- a plate, the plate having:
  - an upper portion;
  - a lower front portion; and
  - a lower rear portion;
- a top channel that extends from the lower front portion of the plate to the upper portion of the plate;
- a bottom channel separating the lower front portion of the plate and the lower rear portion of the plate and positioned substantially perpendicular to the top channel; and
- a hole formed through the upper portion of the plate and the lower rear portion of the plate, the hole receiving a screw inserted therethrough securing the plate to the BB Gun to mount an optic sight to the BB Gun.

2. The scope mount in accordance with claim 1, wherein a distance between the bottom channel and the hole is substantially equal to a distance between a ridge on the BB Gun and a rear screw hole on the BB gun.

3. The scope mount in accordance with claim 1, wherein the top channel is at least two inches long.

4. The scope mount in accordance with claim 1, wherein the top channel is dimensioned to receive therein a ramp of an adjustable rear sight of the BB Gun.

5. The scope mount in accordance with claim 1, wherein the lower front portion of the plate is substantially two inches long.

6. The scope mount in accordance with claim 1, wherein the lower front portion of the plate is between one and three quarters inches and two and one half inches long.

7. The scope mount in accordance with claim 1, wherein the top channel extends from a front of the lower front portion of the plate and extends to an opposite end of the lower front portion of the plate.

8. The scope mount in accordance with claim 1, wherein a distance between the bottom channel and the hole is substantially equal to a distance between a ridge and a rear screw hole on a receiver of the BB Gun.

9. A scope mount for a BB gun comprising:
- a plate, the plate having:
  - an upper portion;
  - a lower front portion; and
  - a lower rear portion;
- a top channel that extends from the lower front portion of the plate to the upper portion of the plate;
- a bottom channel separating the lower front portion of the plate and the lower rear portion of the plate and positioned substantially perpendicular to the top channel; and
- a hole formed through the upper portion of the plate and the lower rear portion of the plate, the hole receiving a screw inserted therethrough securing the plate to the BB Gun to mount an optic sight to the BB Gun,
- wherein a distance between the bottom channel and the hole is substantially equal to a distance between a ridge on the BB Gun and a rear screw hole on the BB gun, and
- wherein the top channel receives therein a ramp of an adjustable rear sight of the BB Gun.

10. The scope mount in accordance with claim 9, wherein the top channel is at least two inches long.

11. The scope mount in accordance with claim 9, wherein the lower front portion of the plate is substantially two inches long.

12. The scope mount in accordance with claim 9, wherein the lower front portion of the plate is between one and three quarters inches and two and one half inches long.

13. The scope mount in accordance with claim 9, wherein the top channel extends from a front of the lower front portion of the plate and extends to an opposite end of the lower front portion of the plate.

14. A scope mount for a BB gun comprising:
- a plate, the plate having:
  - an upper portion;
  - a lower front portion; and
  - a lower rear portion;
- a top channel that extends to from the lower front portion of the plate to the upper portion of the plate;
- a bottom channel separating the lower front portion of the plate and the lower rear portion of the plate and positioned substantially perpendicular to the top channel; and
- a hole formed through the upper portion of the plate and the lower rear portion of the plate, the hole receiving a screw inserted therethrough securing the plate to the BB Gun to mount an optic sight to the BB Gun,
- wherein a distance between the bottom channel and the hole is substantially equal to a distance between a ridge on the BB Gun and a rear screw hole on the BB gun,
- wherein the top channel receives therein a ramp of an adjustable rear sight of the BB Gun,
- wherein the top channel is at least two inches long, and wherein the lower front portion of the plate is between one and three quarters inches and two and one half inches long.

15. The scope mount in accordance with claim 14, wherein the top channel extends from a front of the lower front portion of the plate and extends to an opposite end of the lower front portion of the plate.

16. The scope mount in accordance with claim 14, wherein the rear screw hole is located on the receiver of the BB Gun.

* * * * *